United States Patent [19]

Cornette

[11] Patent Number: 4,586,207

[45] Date of Patent: May 6, 1986

[54] SUNBATHING LEG RISER

[76] Inventor: Clint G. Cornette, #312 34 Ave., Cherry Grove, North Myrtle Beach, S.C. 29576

[21] Appl. No.: 671,890

[22] Filed: Nov. 15, 1984

[51] Int. Cl.[4] ..... A47C 20/08

[52] U.S. Cl. ..... 5/444; 248/156; 297/439

[58] Field of Search ..... 5/444, 443, 431; 297/439; 248/156; 128/133; 269/328

[56] References Cited

U.S. PATENT DOCUMENTS

| | | | |
|---|---|---|---|
| 2,170,724 | 8/1939 | Marquardt | 297/439 |
| 3,141,701 | 7/1964 | Wilkins | 297/439 |
| 3,345,654 | 10/1967 | Noble | 5/444 |
| 3,482,566 | 12/1969 | Watkins | 5/444 |

*Primary Examiner*—Alexander Grosz

*Attorney, Agent, or Firm*—B. Craig Killough

[57] ABSTRACT

Disclosed herein is a device for elevating the legs of a user while sunbathing or otherwise lying down. The device is inserted in pairs into the beach sand or earth, and may be easily and quickly assembled in pairs for transporting and disassembled for use.

4 Claims, 6 Drawing Figures

SUNBATHING LEG RISER

BACKGROUND OF THE INVENTION

The object and purpose of the present invention is to provide a leg riser for use while sunbathing which:

a. will raise the leg to avoid contact with the ground or sand and to keep dirt, sand and other foreign substances off of the legs of the user;

b. will allow rays of the sun to contact portions of the leg which would normally be hidden from the sun due to contact of the legs with the ground or sand; and c. is easily transported and stored.

DETAILED DESCRIPTION OF THE DRAWINGS

DETAILED DESCRIPTION OF THE PREFERRED EMBODIMENT

The present invention is a form of leg riser which may be used while sunbathing to elevate the legs from the earth to prevent contact with the ground or sand to keep sand, dirt or other foreign material from contacting the legs of the human user, while allowing ultraviolet rays from the sun to contact an increased portion of the skin surface of the leg to provide increased tan coverage. The device is used in pairs, with the right foot of the user being placed into one of the risers, and the left foot of the user being placed into the remaining riser. The device may be easily inserted into the ground or sand and provides a rest for the feet and heels of the user. The device is lightweight and provides a locking device so that the device may be connected in pairs when not in use for easy transportation and storage.

Figure 1:
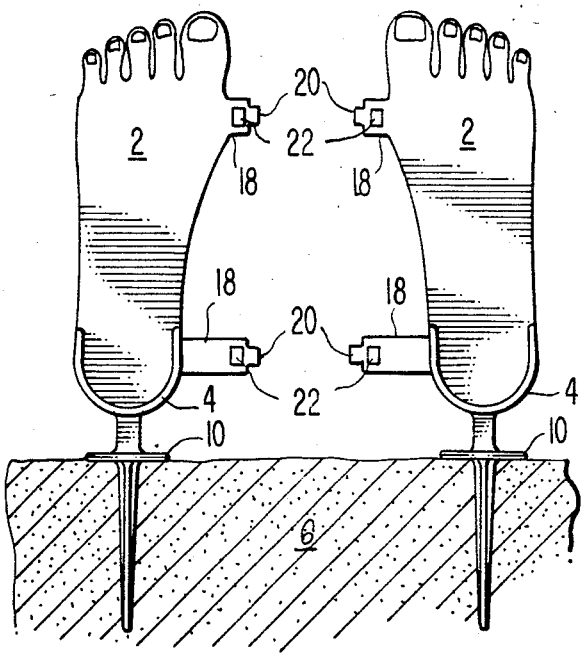
FIG. 1 is a side elevation of a pair of leg risers inserted into sand shown as a sectioned view.

In the preferred embodiment, as shown in FIG. 1, a generally foot-shaped platform 2 is provided. On the lower portion of the device, a heel rest 4 is connected to the platform 2. The device is inserted into the earth or beach sand 6 with the platform 2 generally perpendicular to the beach 6. A pointed stake 8 is provided for easy insertion into the earth, having a guard 10 at the upper end of the stake 8 to limit the depth of insertion of the stake into the earth or beach, and to keep the platform 2 and heel rest 4 at the proper height.

Figure 2:
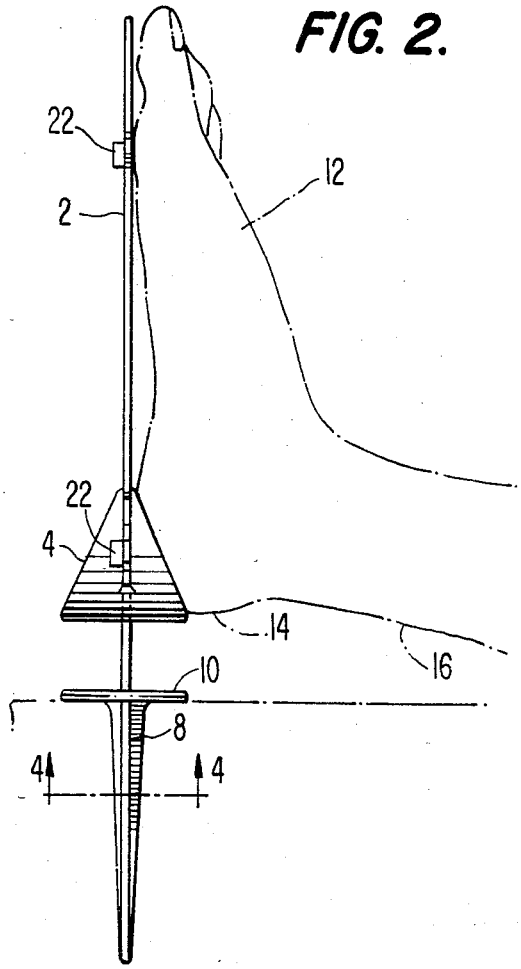
FIG. 2 is an elevation rotated 90 degrees from FIG. 1, showing a user's foot as a phantom located in a leg riser.

As shown in FIG. 2, the user places a foot 12 against the platform 2, with the heel 14 placed into the rest 4. The foot 12 and leg 16 are then somewhat elevated, reducing leg contact with the ground or beach sand 6.

Figure 4:
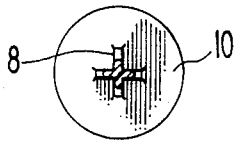
FIG. 4 is a sectioned view taken essentially along line 4—4 of FIG. 2.

FIG. 4 shows the exact configuration of the stake 8 in the preferred embodiment, having a cross shaped cross section and being tapered along its length (FIG. 2), allowing easy insertion into the ground or sand 6. This configuration also aids in reducing movement of the device within the earth, since the cross shape inhibits movement along either the X-axis or Y-axis when the earth is viewed from above.

The leg riser is generally used in pairs, with one leg riser being used for the left foot and one leg riser being used for the right foot. In the preferred embodiment, the device used with the right leg is identical to the device used with the left leg, it being necessary only to rotate the device 180 degrees to use it with one leg as opposed to the other, since the heel rest 4 is present on both sides of the platform (FIG. 2).

Figure 6:
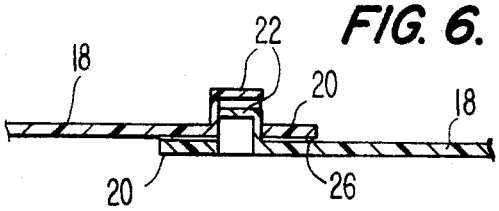
FIG. 6 is a sectioned view taken essentially along line 6—6 of FIG. 5, showing the relationship of the locking devices when the leg risers are connected.
Figure 5:
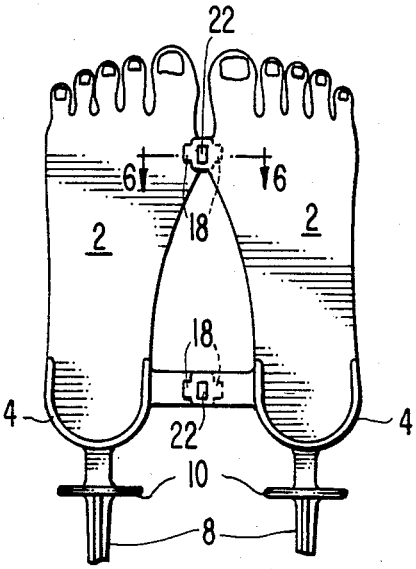
FIG. 5 is a fragmentary, side elevation showing a pair of the leg risers connected together by means of a locking device.
Figure 3:
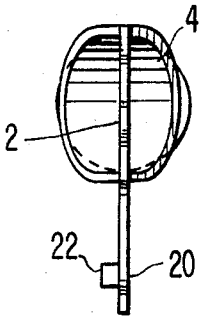
FIG. 3 is a top view of one of the leg risers.

The leg riser also provides a locking device 18, as shown in FIGS. 5 and 6. The locking device 18 allows the leg riser to be quickly and easily connected to each other for easy transportation and storage in pairs. Two locking devices 18 are fitted to each leg riser in the preferred embodiment.

As particularly shown in FIG. 6, each locking device has a male insert 20 and a female receptacle 22. The male insert 20 of one is inserted into the female receptacle 22 of a second unit, with the female 22 of the first unit receiving the male insert 20 of the second. A small raised portion or "nub" 26 of the male insert 20 aids in holding the locking devices together.

The device may be made of any suitable material, but particularly lends itself to construction of injection molded plastic. This substance is lightweight, relatively inexpensive in mass production, and allows all of the features of the device to be incorporated into a one piece unit. Wire may be inserted into the platform portion of the plastic material to increase rigidity, and retard breaking.

What is claimed is:

1. A leg riser for use while sunbathing, comprising:

a. a platform against which a user's foot is placed;

b. a heel rest connected to said platform into which a heel of said user is placed;

c. a stake connected to said heel rest for inserting said leg riser into a portion of earth; and d. a multiplicity of locking devices connected to said leg riser which allow a first of said leg risers to be connected to a second of said leg risers for transportation and storage of said leg risers in pairs, with each of said locking devices comprising a male insert and a female receptacle, with the male insert of one of said leg risers being inserted into the corresponding receptacle of said second leg riser.

2. A leg riser as described in claim 1, further comprising a guard between said heel rest and said stake to limit the depth of insertion of said leg riser into said earth.

3. A leg riser as described in claim 1, and wherein said platform is generally foot shaped, wherein said heel rest is present on both sides of said platform.

4. A leg riser as described in claim 2, and wherein said platform is generally foot shaped, wherein said heel rest is present on both sides of said platform.

* * * * *